US009181670B2

(12) United States Patent
Gagnon

(10) Patent No.: US 9,181,670 B2
(45) Date of Patent: Nov. 10, 2015

(54) LARGE SCALE SPALLATION INDUCING ICE PROTECTION

(71) Applicant: National Research Council of Canada, Ottawa (CA)

(72) Inventor: Robert E. Gagnon, Mount Pearl (CA)

(73) Assignee: National Research Council of Canada, Ottawa, Ontario (CA)

( * ) Notice: Subject to any disclaimer, the term of this patent is extended or adjusted under 35 U.S.C. 154(b) by 0 days.

(21) Appl. No.: 13/896,776

(22) Filed: May 17, 2013

(65) Prior Publication Data

US 2014/0341658 A1 Nov. 20, 2014

(51) Int. Cl.

| | |
|---|---|
| ***E02B 15/02*** | (2006.01) |
| ***B63B 35/12*** | (2006.01) |
| ***E02B 17/00*** | (2006.01) |

(52) U.S. Cl.
CPC ..... *E02B 17/0021* (2013.01); *B63B 35/12* (2013.01)

(58) Field of Classification Search
USPC ..... 405/211, 212, 216, 217; 114/40–43
See application file for complete search history.

(56) References Cited

U.S. PATENT DOCUMENTS

| | | | | |
|---|---|---|---|---|
| 143,003 | A * | 9/1873 | Ford | 114/41 |
| 3,669,052 | A * | 6/1972 | Schirtzinger | 405/217 |
| 4,369,725 | A * | 1/1983 | Lord et al. | 114/40 |
| 2009/0035069 | A1 * | 2/2009 | Krehbiel et al. | 405/212 |

FOREIGN PATENT DOCUMENTS

JP 59126817 * 7/1984

OTHER PUBLICATIONS

Lu, Wenjun et al.—In-plane fracture of an ice floe: A theoretical study on the splitting failure mode, Elsevier Journal, 2014, Cold Regions Science and Technology 110 (2015) 77-101.

* cited by examiner

*Primary Examiner* — Sean Andrish
(74) *Attorney, Agent, or Firm* — James E. J. Davis

(57) ABSTRACT

A technique for protecting a structure from an impact with ice involves providing a horizontal spall initiator extending from the wall a distance of 1 to 10 cm, the horizontal spall initiator being resilient to the ice impact, and formed by blade segments having a blade width less than ½ a thickness of an expected hard zone of the ice; and situating the horizontal spell initiator at an elevation of the expected hard zone. Situating the horizontal spall initiator at an elevation of the hard zone may involve providing an elevation control mechanism (e.g. buoyancy, mechanical, or hydrodynamic), or may involve a panel with a plurality of horizontal spell initiators at respective elevations. The horizontal spell initiator may be driven.

20 Claims, 10 Drawing Sheets

LARGE SCALE SPALLATION INDUCING ICE PROTECTION

FIELD OF THE INVENTION

The present invention relates in general to a method and apparatus for protecting a structure from ice loading and vibrations during ice-structure interaction, and in particular to protection for structures from ice where there is substantial force between the ice and the structure, by a horizontal spall initiator, striking a hard zone of the ice contact area.

BACKGROUND OF THE INVENTION

Ice crushing against stationary structures can be dramatic. On May 12, 1986 the north and north-east faces of the Molikpaq caisson facility, during operations at the Amauligak I-65 site in the Canadian Beaufort Sea, encountered an ice floe approximately 7 km×15 km×~2 m. The ice-structure interaction induced vibration, and throughout a significant part of the 27 minutes the floe was moving, extensive crushing of the ice was observed. Cyclic oscillations of load occurred, reaching 250 MN.

The cyclic oscillation of the structure has been explained in terms of ice spalling. The elastic stress in the ice is partially relieved during each spelling event, where the ice is actually penetrated by the structure. The mechanisms that enable the rapid penetration of ice during a spelling event are complex (Gagnon, 1999). A spalling event generally refers to what happens when a portion of relatively intact ice rapidly separates from the ice contact region and shatters, leading to a sudden drop in load, and a surge of the ice toward the structure during the load drop. The shattered spalls have properties of crushed ice, that is, capable of supporting low pressure whereas the remaining ice, such as the central horizontal region of the ice sheet (known as the hard zone), will remain relatively intact and be capable of supporting high pressure. Following each spelling event the penetration into the ice sheet temporarily ceases and load begins to increase again on the ice in the contact zone as the bulk ice sheet continues to move against the structure and generate elastic stress until the next spalling event occurs. This leads to a characteristic sawtooth load pattern.

The important point is that the structure may experience hazardous oscillations due to ice-structure interaction when the spalling rate is at or less than the resonant frequency of the structure-ice system. Large scale structures, such as the Molikpaq caisson facility, are able to withstand considerable forces, however the vibrations caused by ice-structure interactions are dangerous for personnel and equipment, and may result in a risk against the structural integrity of the facility.

There are several prior art techniques for cutting ice. For example, U.S. Pat. No. 3,521,592 to Rosner et al. teaches a cutter mounted to a prow of a marine vessel with a plurality of rotary vertically extending ice engaging units, each unit presenting an array of radially extending ice chopping blades or cutters. The ice engaging units are desirably movable vertically for positioning for optimum efficiency. FIG. 2 of Rosner et al. schematically shows a unit with a dozen blades or cutters.

There is a need for an efficient mechanism for improving protection of structures during ice-structure interactions.

SUMMARY OF THE INVENTION

Applicant has discovered that improved protection against ice-structure interactions can be provided by providing a horizontal spall initiator that extends substantially across the structure parallel to the plane of the ice sheet, between the top and bottom edges of a hard zone defined by the ice-structure interaction.

Accordingly, a method for protecting a structure from impact with ice is provided. The method involves providing a horizontal spall initiator extending from a wall of the structure a distance of 1 to 10 cm, the horizontal spall initiator being resilient to the ice impact, and having a blade width less than ½ a thickness of an expected hard zone of the ice; and situating the horizontal spall initiator at an elevation corresponding to the expected hard zone. The horizontal spall initiator may be provided by a continuous horizontal blade on the wall, or on a panel on the wall.

A profile of the at least one blade segment may have an aspect ratio of 2:1 to 1:1

The horizontal spall initiator may have a plurality of blade segments that are separated from each other to discontinuously define the horizontal spall initiator. For example, providing the horizontal spall initiator may involve providing a single blade segment on each of a plurality of panels, and aligning the panels' blade segments. Each single panel may provide a plurality of horizontal spall initiators at respective elevations. Each of the plurality of horizontal spall initiators may be defined by a plurality of blade segments. Separations between adjacent blade segments on the same row may be provided, and blade segments may be systematically aligned with separations in adjacent rows, to interleave blade segments of different elevations.

Situating the horizontal spell initiator may involve controlling an elevation of the panel with respect to the wall. Controlling the elevation of the panel may involve mounting the panel for sliding movement, the sliding movement being controlled by a mechanical system, hydrodynamic system, buoyant system or a combination of the above.

The wall may be a wall of a pillar, in which case the panel may be a part of a sleeve that surrounds the pillar, and the sleeve may be joined to the pillar in a revolute, or non-revolute fashion.

The horizontal spell initiator may be driven cyclically into the ice during an ice-structure interaction.

Also accordingly, a kit is provided, the kit comprising at least one of: material for producing a horizontal spall initiator on the wall; or a panel as described above, and instructions for using the material or panel in accordance with the method described above. If the kit includes a panel, the kit may further include a mounting system for mounting the panel to the wall. The mounting system may allow for varying an elevation of the horizontal spall initiator prior to encountering an ice floe, to align the horizontal spall initiator with the expected hard zone; or may provide a driver for driving the horizontal spall initiator into the ice during an ice-structure interaction. The mounting system may include one or more of a mechanical system, a hydrodynamic system, and buoyancy system for controlling the variation of the elevation. The panel may be a part of a sleeve for surrounding a pillar.

Also accordingly, an apparatus is provided for protecting a structure from impact with ice, the apparatus comprising: one or more panels for mounting to a wall of the structure, the panel alone, or panels in combination, providing an horizontal spell initiator extending across the wall, and projecting from a surface of the panel a distance of 1 to 10 cm, wherein the horizontal spall initiator is resilient to the ice impact, and has a blade width less than ½ a thickness of an expected hard zone of the ice; and a mounting system for retaining the panel to the wall and for controlling an elevation of the panel with respect to the wall.

The mounting system may include: a mechanical system, a hydrodynamic system, a buoyancy system, or a combination of the above for controlling the elevation; or a driver for driving the horizontal spall initiator into the ice during an ice-structure interaction.

If the wall is a wall of a pillar, the panel may be a part of a sleeve that surrounds the pillar, and the sleeve may be joined to the pillar in a revolute, or non-revolute fashion.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Herein a technique for protecting a structure from an ice floe is described. An ice-structure interaction, herein, refers to a sheet of ice that is at least 0.2 m thick (typically 1-3 m), that moves in a direction perpendicular to the thickness towards a wall of the structure. The thickness is herein equated with the vertical direction, and if the sheet were to move vertically, as a result of a substantially non-vertical surface of the structure wall, substantially different deformation behaviors (flexure) would typically be exhibited by the ice sheet.

Figure 1:
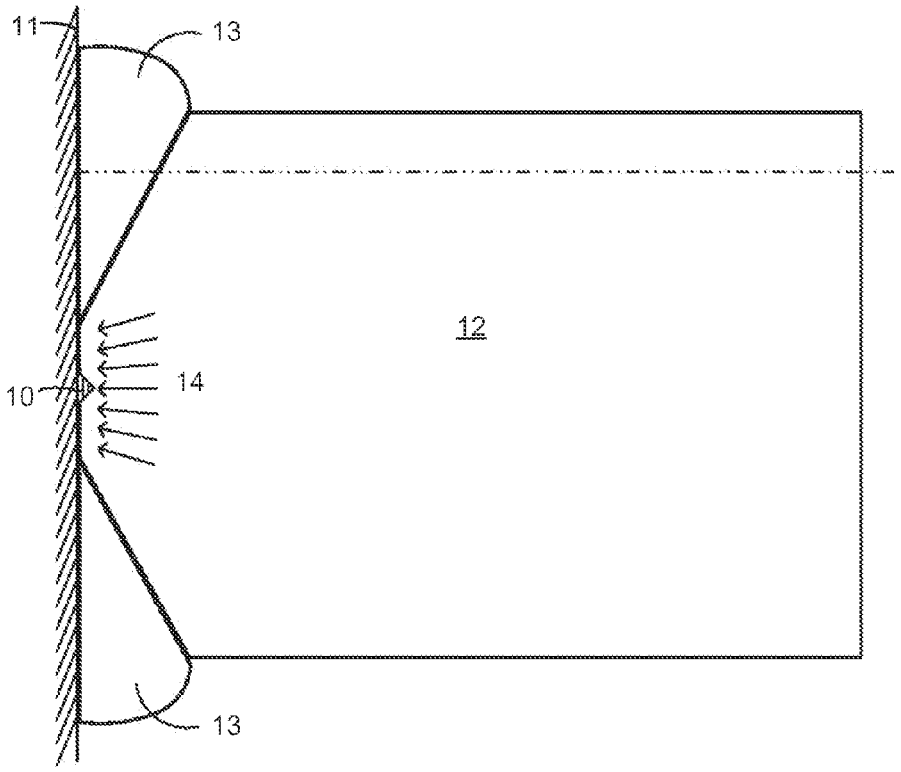
FIG. 1 is a schematic illustration of a single horizontal blade attached to a wall of a structure at an elevation so that it is inside a hard zone of an ice-structure interaction with the wall.

FIG. 1 illustrates a vertical cross-section through an ice sheet 12, and a vertical wall 11 during an ice-structure interaction. The geometry is known in the art. The ice sheet naturally ruptures along its top and bottom leading edge first, leaving a hard zone 14 that is substantially rectangular, having a fraction of the thickness of the ice sheet. Specifically the thickness of the hard zone is typically 1% to 30%, more commonly 3% to 20% of the thickness of the sheet. Published experiments and observations generally show a hard zone thickness of roughly 3-10% of the thickness of the sheet.

FIG. 1 shows the simple case of a single horizontal blade 10 attached to the vertical wall at an elevation so that it is inside the hard zone of the ice sheet that is encroaching on the structure. The blade accelerates the initiation of spalling events where the spalls become crushed ice 13, and is perhaps a simplest example of a horizontal spall initiator.

While the wall in FIG. 1 is vertical, it will be appreciated by those of skill in the art, that a wall that is inclined to a small angle, such as an angle lower than 15° will have a similar hard zone, and crushed ice zone. It will be noted that the Molikpaq caisson facility had an angle of ~8° from the vertical at the water level. It will further be noted that the angle out of plane is substantially irrelevant. That is, if the ice floe is travelling in a direction oblique to the wall, the component of the velocity that directs the floe to the wall results in a force that will drive the spallation, regardless of the transverse velocity. Accordingly, the present invention does not require the wall or the horizontal spall initiator to be normal to the velocity of the sheet.

The blade need not extend very far from the surface of the wall, to protect the structure. In fact, a blade that projects from the surface by one $70^{th}$ of the thickness of the ice sheet has been shown to work as a horizontal spall initiator. The blade may therefore be 1-10 cm deep. For particular sites expecting ice flows up to 3 m thick, a reasonable blade thickness would be just over 4 cm. A width of the blade (vertical extent of the blade section) should be less than ½ a thickness of an expected hard zone of the ice, otherwise it may be difficult to situate the blade within the hard zone reliably.

The horizontal spall initiator need not be defined by a continuous blade, as a plurality of blade segments that cover about 80% of the hard zone would be expected to be equivalent under all circumstances, if the 20% that had no protrusion were evenly separated along the hard zone. It is further expected that as much as 20% coverage, with 80% space in between, may yet provide enough protection and nucleate sufficient cracks to reduce peak loads on the wall sufficiently to reduce a surface area of the hard zone, resulting in a valuable reduction in induced oscillations of the structure during ice-structure interaction. Thus some spaced-apart blade segments within the hard zone would constitute a horizontal spall initiator, as the term is used herein.

It is believed that one and only one horizontal spall initiator should be in contact with the hard zone for the blade to be most effective. It is expected that two horizontal spall initiators both within the hard zone, may decrease efficiency of the spallation substantially. If there are a narrow range of elevations at which the ice can encounter the structure, and ice sheets are expected in a fairly narrow range of thicknesses, it may be desirable to use a single fixed horizontal blade as shown in FIG. 1.

Figure 2:
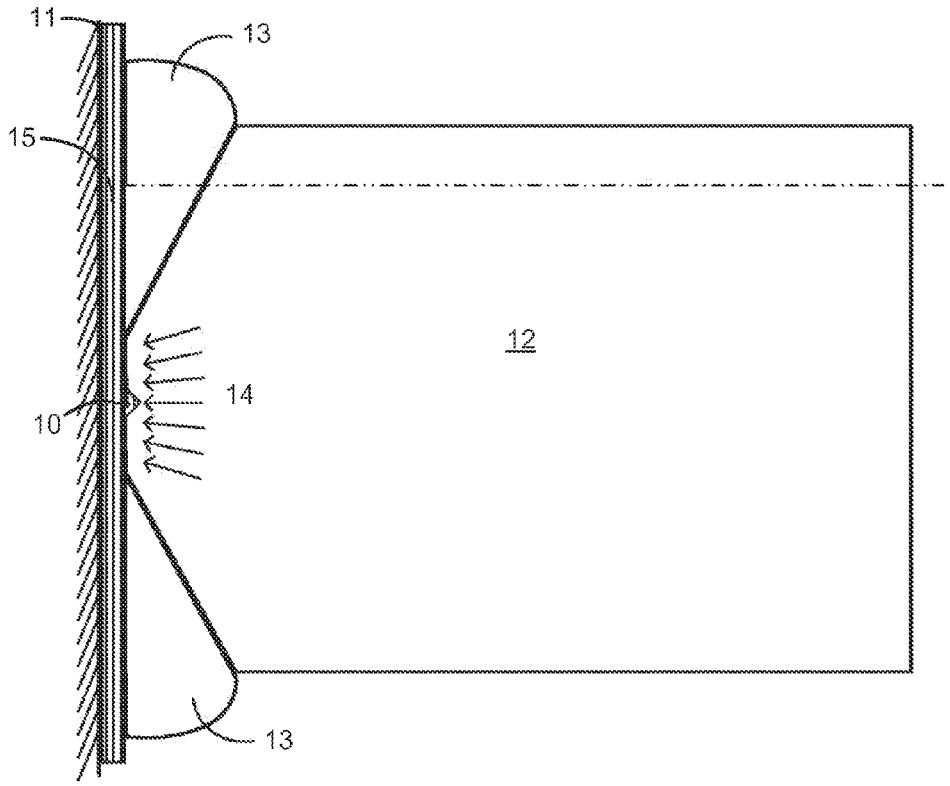
FIG. 2 is a schematic illustration of a panel featuring a single horizontal blade attached, the panel mounted to a wall of a structure at an elevation so that it is inside a hard zone of an ice-structure interaction with the wall.

This may not be possible, given that the water level in some parts of the Arctic varies roughly by 2 m. FIG. 2 illustrates an embodiment, similar to FIG. 1, except that the horizontal spall initiator is on a panel 15 that can be moved in the vertical direction to take account, for example, of a changing tide level, or a thickness of the ice floe. The panel may be composed of hard UV-protected plastic (e.g. polypropylene), metal, alloy (e.g. steel), ceramic or composite. The panel may be movable using a variety of mechanisms, known in the art, and may have sliders or runners for preventing motion in degrees of freedom other than vertical translation.

Figure 3A:
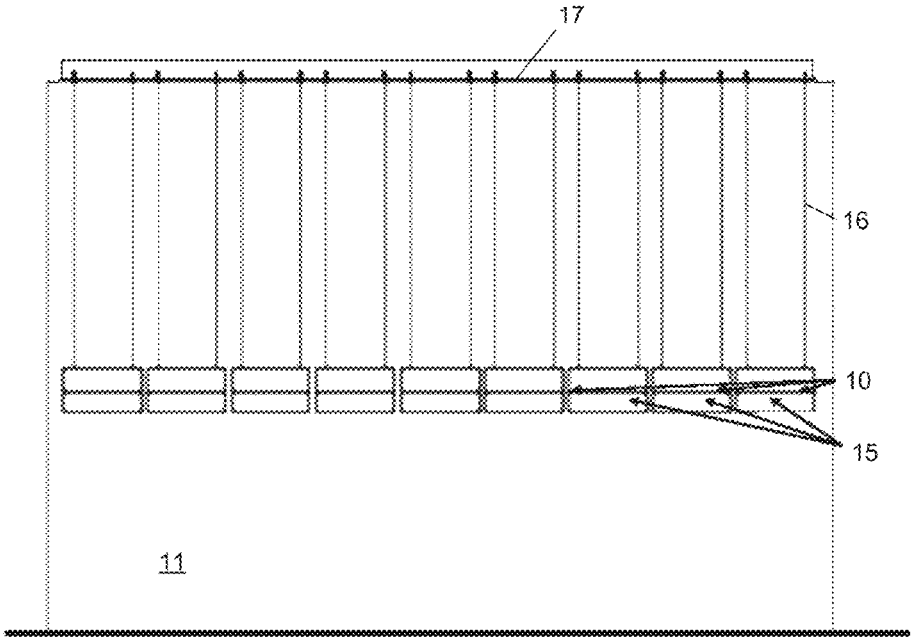
FIGS. 3*a,b* are schematic illustrations of a plurality of panels mounted to a wall by a winch system, collectively defining a horizontal spall initiator at a controlled elevation.
Figure 3B:
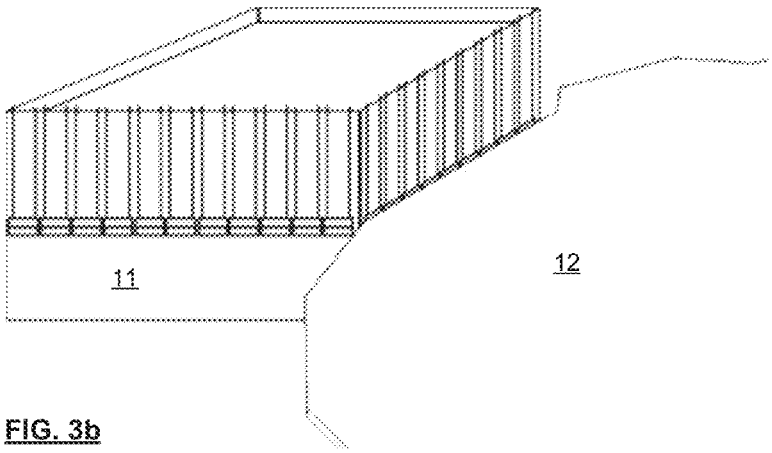

FIGS. 3*a,b* illustrate a system of panels according to FIG. 2, on a wall of a large offshore structure. These panels are modular, each having a single section of the horizontal spall initiator. The elevation of the panels is controlled by a system of winches 17 and chains 16 (or equivalently, cables) that individually, or collectively, raise or lower the panels. Preferably all of the panels can be raised or lowered collectively, and each panel can be individually adjusted by a smaller height. FIG. 3*b* is a perspective illustration of the embodiment of FIG. 3 showing an encroaching ice sheet.

One needs a reasonable idea of the ice sheet thickness in order to accurately position the horizontal spall initiator at the mid-height of the ice thickness where the hard zone is expected. Ice floes can be sensed from some distance (visually from the structure or from an aircraft) to allow for the positioning. A wide variety of sensors can be used as well, and such sensors may be included on the panels or otherwise on the wall or in the structure. One example is an underwater acoustic ranging system.

In one embodiment, the substantial normal forces on the panels during the interaction with the ice sheet, serves to lock the panels in place, to prevent vertical motion of the panels, throughout the interaction. In another embodiment the panels are movable vertically during the ice-structure interaction to improve an alignment of the blade segments of the horizontal spall initiator with the hard zone. This vertical motion during the interaction may be a part of a mechanical feedback produced by the ice sheet and structure system, or another sensor.

FIG. 4 is a schematic illustration of a range of blade profiles of a blade segment for use as a horizontal spall initiator. While this is not necessary, it is assumed that the blade segment will have a constant profile along its length, for example, across an extent of each panel. While the blade projection depth may be constant, the profile may vary regularly or irregularly along the length of the panel. Specifically, it may be desirable to reinforce the blade segment at regular or semi-regular intervals to improve a resilience of the blade segment, an adherence of the blade segment to the panel or wall, or to alter the effectiveness of the horizontal spall initiator for ice floes of different thicknesses, for example.

The depth of projection of the profile being 1-10 cm, at the outside, a base of the profile (a thickness where the blade meets the surface of the panel or wall), may advantageously be 1-20 cm, and the aspect ratio (base:depth) of the profile may preferably be 1:1 to 2:1, which is expected to be sufficient for commonly available strong and hard materials to provide low probability of the blade section being shorn off, bent/crumpled, or otherwise failing in flexural mode during ice-structure interaction. Other aspect ratios may be provided if the blade segments are able to withstand the ice-structure interaction forces without deforming (buckling, bending, folding, crushing, deflecting) or separating from the panel or wall (tearing, splitting or delaminating, etc.).

Figures 4A, 4B, 4C, 4D, 4E, 4F:
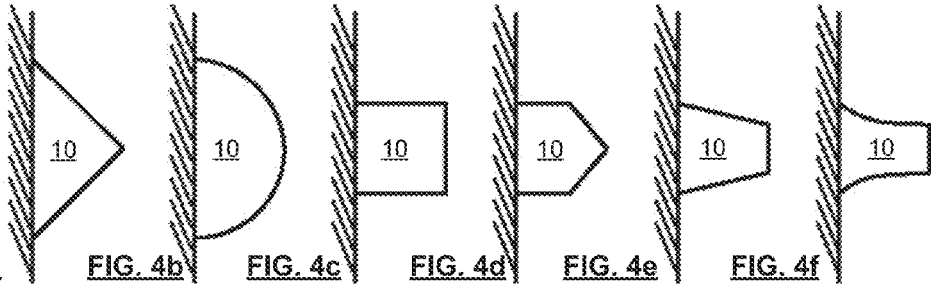
FIGS. 4*a,b,c,d,e*, and *f* schematically illustrates 6 blade cross-sections of a horizontal blade or blade segment of a horizontal spall initiator.

FIGS. 4*a,b,c,d,e*, and *f* show a variety of profile geometries, each of which can have the variety of aspect ratios and dimensions described above. The profile of the blade segment can be triangular (FIG. 4*a*), semicircular (FIG. 4*b*), or rectangular (square as in FIG. 4*c*), for example. The profile may further be compounded of two base shapes, such as a square base with a triangular tip (FIG. 4*d*). The profile may be a section of a base shape, such as a triangular blade with a triangular tip removed to form a trapezoidal shape (FIG. 4*e*). Furthermore the profile may have a curved sidewall as shown in FIG. 4*f*. Such a curve may be a product of how the blade segment is joined with the wall or panel, such as by welding. While each example was symmetrical, which would be natural as shearing forces will be expected substantially equally on either side, this is by no means necessary. These illustrated profiles are merely illustrative, and it will be appreciated by those of ordinary skill, that a wide variety of others could be used to the same effect.

Figure 5A:
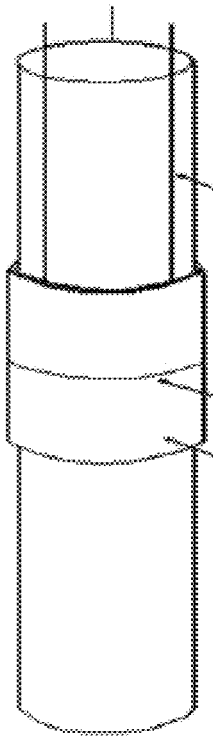
FIGS. 5*a*, and *b* schematically illustrates panels with horizontal spall initiators formed as parts of sleeves for two types of columnar walls.
Figure 5B:
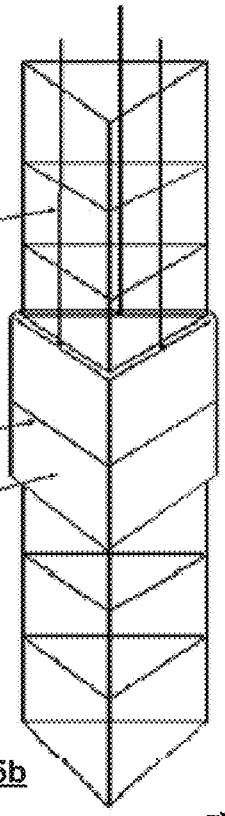

FIGS. 5*a*, and *b* schematically illustrate the invention in use on walls of two pillars, commonly used in offshore structures. FIG. 5*a* shows a leg of a jackup-type facility that typically stands on the sea floor, with legs typically having three or four flat sides so that a panel that looks like a triangular shaped sleeve with a horizontal spall initiator on it. FIG. 5*b* shows a cylindrical member, which might be a leg of a structure that stands on the sea floor or a member of a moored floating structure. In either case the panel is a sleeve (cylindrical or triangular, or otherwise to match a pillar cross-section) that can slide up or down on the member. The elevation of the sleeve is preferably controlled by a mechanical tool (hoist or winch with chains, helical, or vertical guide path, or mechanical coupling), hydrodynamic tool (one or more hydrodynamic control surface), or a combination of the above.

One difference between a jackup-type facility and a cylindrical member is that the triangular cross-section makes for a natural prismatic joint. It may not be desirable to allow a torsional load to be borne by the jackup-type leg, and features may be added to the cylindrical member to prevent revolution, so in either case the sleeve may be revolute or prismatically joined to the pillar.

Furthermore, although the horizontal spall initiator shown encircles the member, in an alternate embodiment the horizontal spall initiator could be provided to face an outside of the structure. In such an alternate embodiment, the sleeve may be revolute and orientable. For example, marine current may direct this orientation, using well known hydrodynamic surfaces, and contact with the ice sheet may prevent revolution of the sleeve. To accommodate a variation of the ice velocity with respect to the marine current, a further mechanism may be used, either prior to contact with the ice sheet, or during the contact, if the forces between the panel and ice can be overborne.

Figure 6:
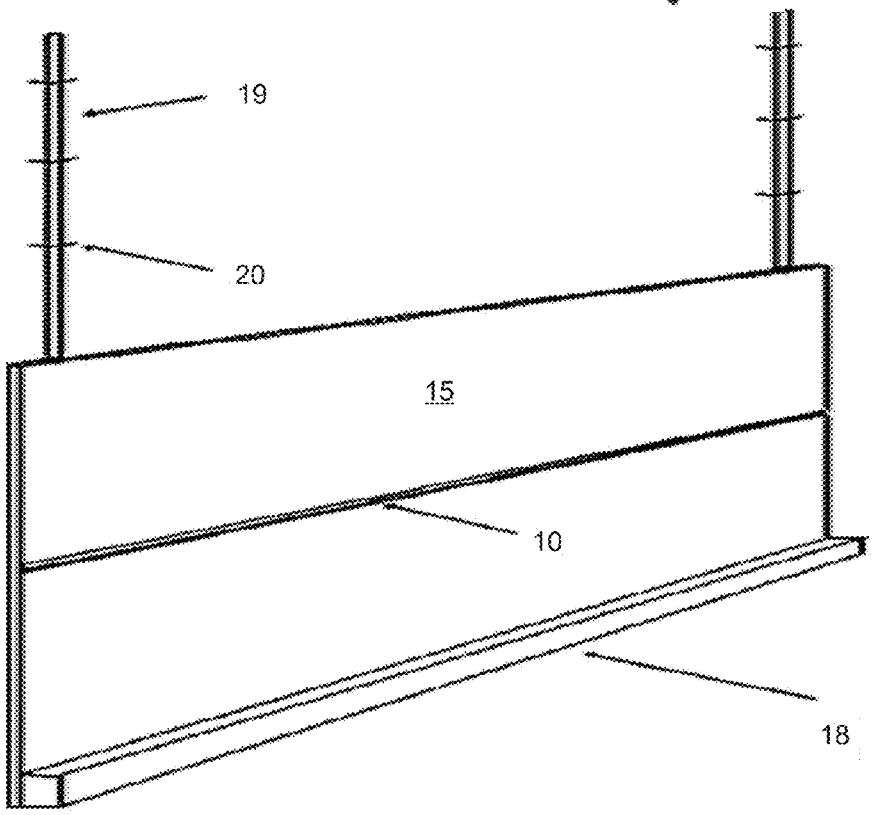
FIG. 6 schematically illustrates a panel that is mounted with buoyancy-controlled elevation.

FIG. 6 schematically illustrates a panel with a single horizontal spall initiator on it that uses buoyancy exclusively to achieve the proper elevation. As ice sheets float on water with a fixed mass ratio under and above water, a variation in the centre of the ice (hard zone) from the water level, as a function of thickness is less than half the thickness. For a given range of ice thicknesses, the variation in the optimal elevation of the horizontal spall initiator may be relatively small, requiring small displacements of the panel.

In this case the panel is preferably made of plastic, and is approximately neutrally buoyant. The panel has a suitably sized air chamber, or volume of buoyant material, defining a buoyant chamber 18 at the bottom (although it could be anywhere underwater, in principle). There are two guide rods 19 at the top of the panel and guide rings 20 that are fixed to the wall of the structure. The panel is made of plastic because a steel panel would be so heavy that a very large buoyancy chamber would be required and it would stick out from the panel and cause torque about the horizontal axis and potential jamming of the guide rod system with the wall shown. However, in other applications it may be possible and convenient to use hollow metal structures, for example. The guide rod system can be at the top or bottom of the panel or at both the top and bottom. While the guide rod system is shown with numerous specific preferences, a wide variety of prismatic joints of various configurations could equally be employed.

It will be noted that any mechanism used to provide a panel in accordance with the enumerated embodiments should be designed to withstand wave splash and avoid freeze-in. Freeze-in may be avoided with resistive heating elements, adjacent to moving parts, for example. In some embodiments, shaping of the panels may reduce wave splash, if the current flow pattern is predictable and repetitive.

As noted above, the spall initiator should be generally horizontal, but does not require a continuous blade, to initiate horizontal spalling. FIGS. 7*a-d*, 7*e-h*, and 7*i-m* schematically illustrate three panels 15' that allow for creation of a plurality of horizontal spall initiators in a discontinuous fashion (using blade segments), at a plurality of elevations, concurrently. Each panel is shown in front view in a first of the associated figures, and end, too and side views of one of the blade segments are provided in the other associated figures. These panels can inherently address tidal elevation variance without requiring the panels change in elevation, and so can be fixed on the structure. Advantageously, the horizontal spall initiator may span the normal or expected tidal elevation range. The panels have a size and aspect ratio that is convenient for the specific application. An array of blade segments may have any fixed or varying density to provide the degree of protection at any resulting thickness of hard zone at any elevation. Such panels may be welded, bolted or hung from cables/chains on the walls of the structure, or integrally formed thereon. The panels may have shallow recesses to provide a root for retaining, or assisting in the retention of, each blade segment in the array, or other means to countersink the blade segment, or the blade segments may be provided.

Figure 7D:
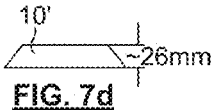
FIGS. 7*a,b,c,d*, 7*e,f,g,h*, and 7*i,j,k,m* schematically illustrate 3 panels having a plurality of horizontal spall initiators at respective elevations.
Figure 7C:
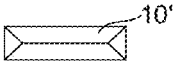
Figure 7B:
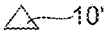
Figure 7A:
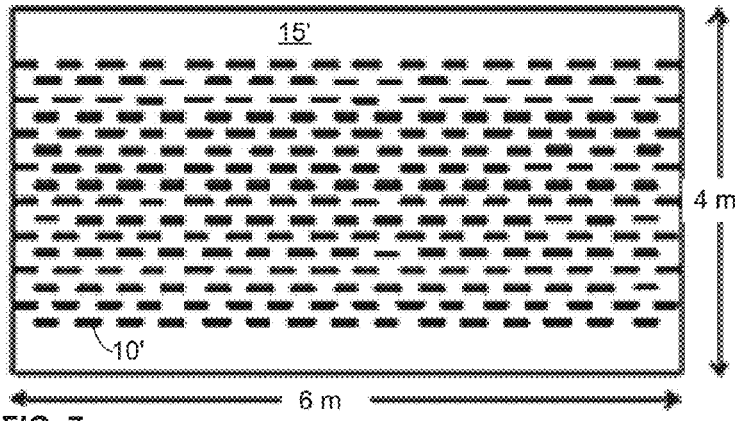
Figure 7H:
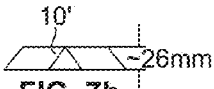
Figure 7G:
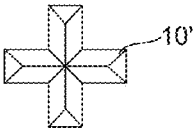

FIG. 7*a* shows a panel with a multitude of identical horizontally-oriented blade segments. This configuration would probably be most suited to ice-structure interaction because the blade segments are horizontal (as seen in FIGS. 7*b,c,d*) and would tend to cause spalling in the upward and downward directions. The array spans roughly 3 m in the vertical direction so it can adequately handle tidal changes of approximately 2 m. Hence the hard zone region of the ice sheet would always be in contact with some blade section no matter what the tide height is. The blade segments that are in the crushed ice region of contact would cause little resistance to extrusion of the crushed ice because of their low profile, and therefore have little effect. The blade segments have a staggered pattern so that the next blade segments directly above or below any particular blade segment is 2 levels away. The two level space distance is chosen to be somewhat greater than the vertical width of the hard zone anticipated for the thickest ice sheet expected for that particular location (geographic region). The hard zone thickness is roughly 10% of the thickness of the ice sheet. Therefore no two blade segments at the same horizontal position would ever be encompassed by the hard zone, thereby avoiding confinement of hard zone portions between blade segments that could impede the desired spalling behavior.

Figure 7F:
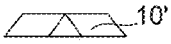
Figure 7E:
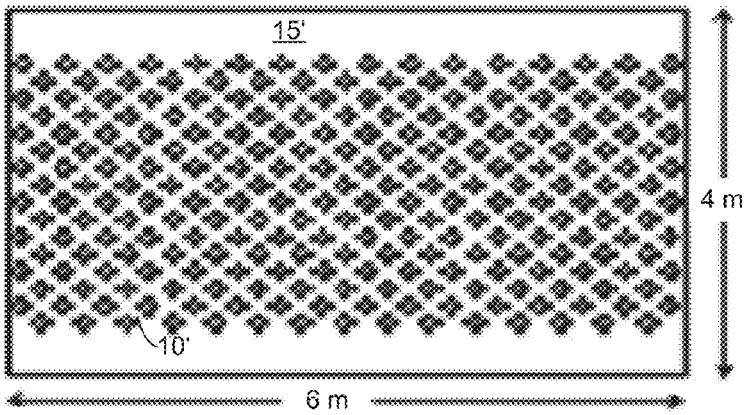
Figure 7M:
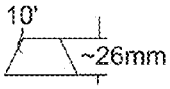
Figure 7K:
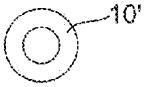

FIG. 7*e* shows a panel with a multitude of identical cross-shaped blade segments (the cross-shaped blade segments shown enlarged in FIGS. 7*f,g,h*). This configuration is expected to work as well and possibly better than the panel in FIG. 7*a* in certain circumstances. For example in FIG. 7*a*, though unlikely, it could happen that a thin horizontal hard zone (from a relatively thin ice sheet) lies in between horizontal spall initiators and the next one above or below it, so that no horizontal spall initiator is effectively in the hard zone. In contrast, the configuration in FIG. 7*e* has vertical components of the cross-shaped blades that would more likely lie within the thin hard zone and may initiate spalling of thinner ice sheets.

Figure 7J:
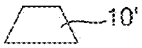
Figure 7I:
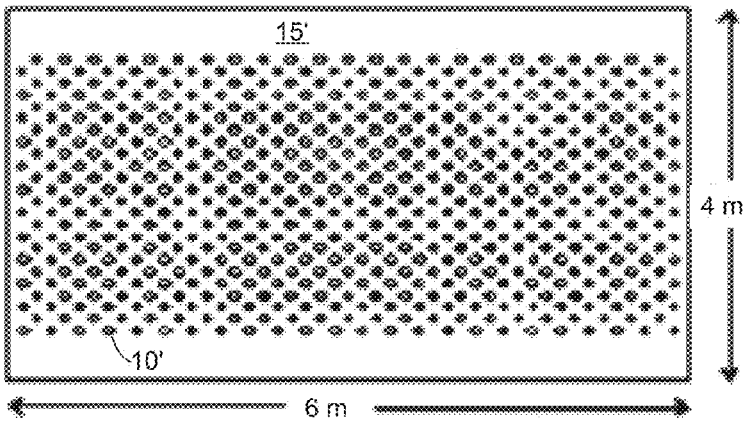

FIG. 7*i* is a simplification of the embodiment of FIG. 7*e*, in which symmetric cross-shaped blade segments are replaced with perfectly symmetric frusto-conical blade segments shown in FIGS. 7*j,k*, and *m*. These are more closely spaced than the cross-shaped blade segments because individually they take up less area. Naturally frusto-pyramidal blade segments could alternatively be used, having a desired polygonal base. It will be noted that the blade segments of FIG. 7*i* could be nut heads, bolt heads, screw heads, or rivet heads of a fastener that fastens the blade section to the panel. While a tool may be provided for gripping a smooth, conic wall of the blade segments illustrated, it may be preferable to provide a surface that is more readily gripped by such a tool, to facilitate a strong fastening of the blade section to the panel.

Any of the three panels shown in FIGS. 7*a,e,i* could be used for the case of an ice sheet encroaching on a structure. Which works best may be determined through laboratory tests similar to the tests presented herein below.

Furthermore these blade-array types could be of similar value in the event of non-sheet ice-structure interaction such as when a small iceberg (berry bit, or growler) impacts a fixed or floating offshore structure. In that case the blade segments have the effect of reducing the overall peak load, similar to what is shown in the ice crushing experiments described herein below, and also of reducing the size of the hard zone so that the load is not as concentrated on structural components.

Figure 8:
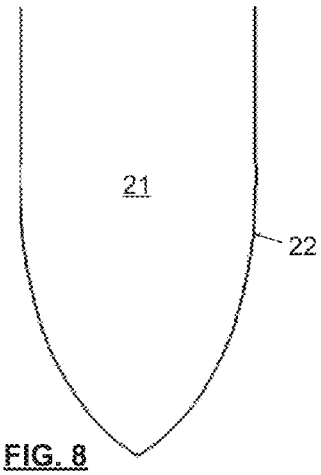
FIG. 8 is a top view of a ship showing a shoulder.
Figure 9:
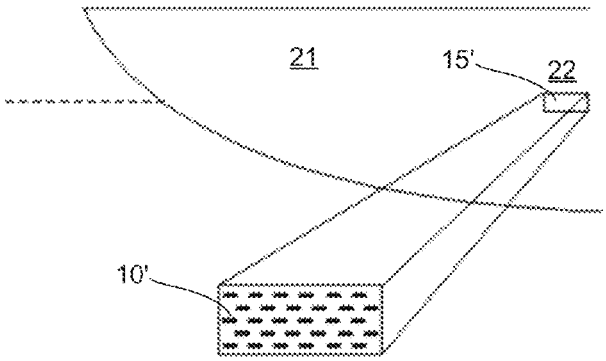
FIG. 9 is a side view of the ship of FIG. 8 having a horizontal spall initiator array on the shoulder to protect the ship from ice jamming.

FIGS. 8 and 9 schematically illustrate another potential application. Ships 21 sustain damage in the shoulder areas 22 when transiting through ice sheets. This happens as the result of jamming that occurs when both nearly vertical "shoulder areas" of a vessel collide with ice sheets on opposite sides of the vessel at the same time. This situation may be analogous with an ice-structure interaction in that the ice sheets are constrained and under substantial pressure, and confined to a plane. Arrays of relatively shallow blade segments of the type in FIGS. 7*b-d* are shown attached at the shoulder areas, where the peak loads are expected. The blade segments collectively define a horizontal spall initiator running the length of the hard zone, and are expected to reduce concentration of load buildup during the ice-structure interaction. Spacing of the horizontal spall initiators would depend on the typical ice thickness expected.

A wide variety of arrangements of blade segments can be envisaged, and each may work satisfactorily in a variety of situations. Depending on a degree of protection sought, a spacing between the blade segments may be relatively wide. If so, the protection will be suboptimal, but may provide for sufficient reduction in stresses during an ice floe-structure interaction to avoid damage and injury. Naturally, designs for specific installations will require simulation studies and empirical tests to ascertain the degree of protection afforded, which will depend largely on the structure to be protected and the anticipated ice floes.

While the illustrated cases above show fixed horizontal spall initiators, an array of horizontally driven and oriented horizontal spall initiators that would punch/run into the hard zone area of the ice contact region could be used to initiate/nucleate spall-creating fractures. Furthermore, the running of the horizontal spall initiators could be timed in such a way as to avoid simultaneous spelling across the structure face in favour of many smaller spalls spread out in time to reduce peak global loads. The drivers could be hydraulic, pneumatic, or mechanical, and the horizontal spall initiators could be driven independently or collectively. The amplitude of the thrusting horizontal spall initiator would be roughly the depth of the blades as described above. The horizontal spell initiators would preferably pass through apertures in the wall and or a panel having slits therefor.

Experiments

Figure 10C:
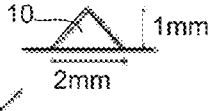
FIGS. 10*a,b,c* is a schematic illustration of a blade on an aluminum plate used to verify the present invention.
Figure 10B:
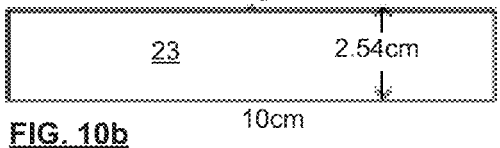
Figure 11:
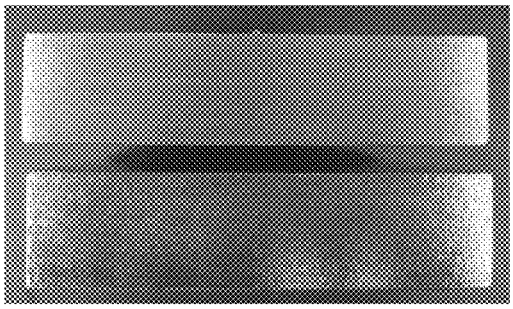
FIG. 11 is an image of aluminum plates with and without blades used for verifying the invention.
Figure 10A:
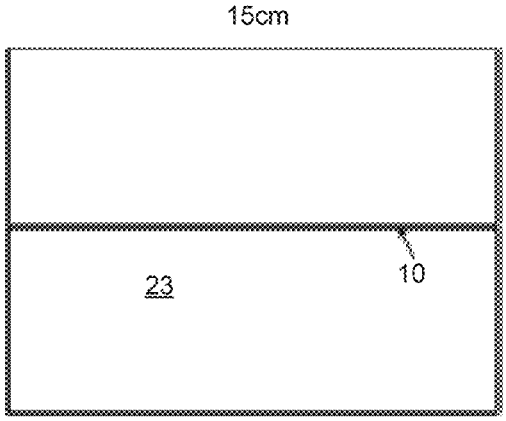

A simple stationary configuration of a single blade on a flat metal plate was tested for ice crushing tests in Applicant's Cold Room facility. The idea was to crush five samples of ice against a plate with a blade on it and compare those results with those from another five crushing experiments using a flat plate without a blade. The two plates were made of aluminum and had identical characteristics other than that one of the plates had a blade on it. Dimensions of the plate with the blade (10×15×2.54 cm) on it are shown in top plan view in FIG. 10*a*, and in side elevational view in FIG. 10*b*, and the blade profile (triangular base=2 mm, height=1 mm) is shown in FIG. 10*c*. FIG. 11 is a photo of the ends of the two plates. The profile of the small triangular-shaped blade is visible on the top of the upper plate.

Figure 12:
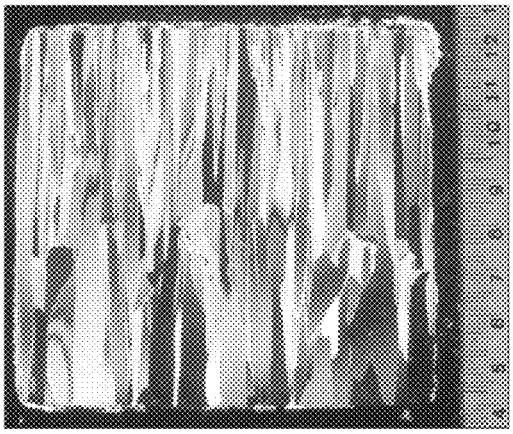
FIG. 12 is an image of a thin section of columnar ice crystals used in verifying the present invention.
Figure 13B:
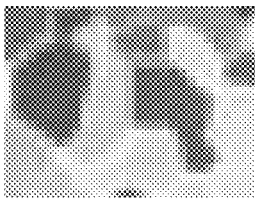
FIG. 13*b* is an enlargement of a patch of the image of FIG. 13*a;*
Figure 13A:
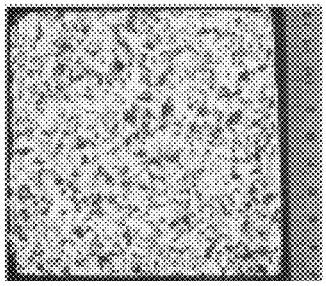
FIG. 13*a* is an image of a thin section the columnar ice taken cross cutting the columns.

A columnar-grained freshwater ice sheet, from which ice specimens were cut, was grown in a basin in the cold room. Columnar freshwater ice was chosen for the tests because it is fairly easy to grow and shape, and furthermore sea ice sheets also have columnar grains. The grain structure of the ice is shown in FIGS. 12 and 13*a,b*. FIG. 12 shows the macroscopic grain columns. The image is of a ~50 $cm^2$ face of a thin section of the block, viewed through cross-polarized filters. FIG. 13*a,b* are images viewed through cross-polarized filters, at different enlargements, of a thin section that cuts across the columnar grains, having a similar dimension as the thin section imaged in FIG. 12. FIG. 13*b* is an enlargement of a section of FIG. 13*a*.

The ice samples were initially brick-shaped, as viewed from above, when cut from the ice sheet. Each sample was mounted on edge and lengthwise in its holder. The edge of the brick-shape that projected out of the ice holders was given a rounded wedge shape.

Figure 14:
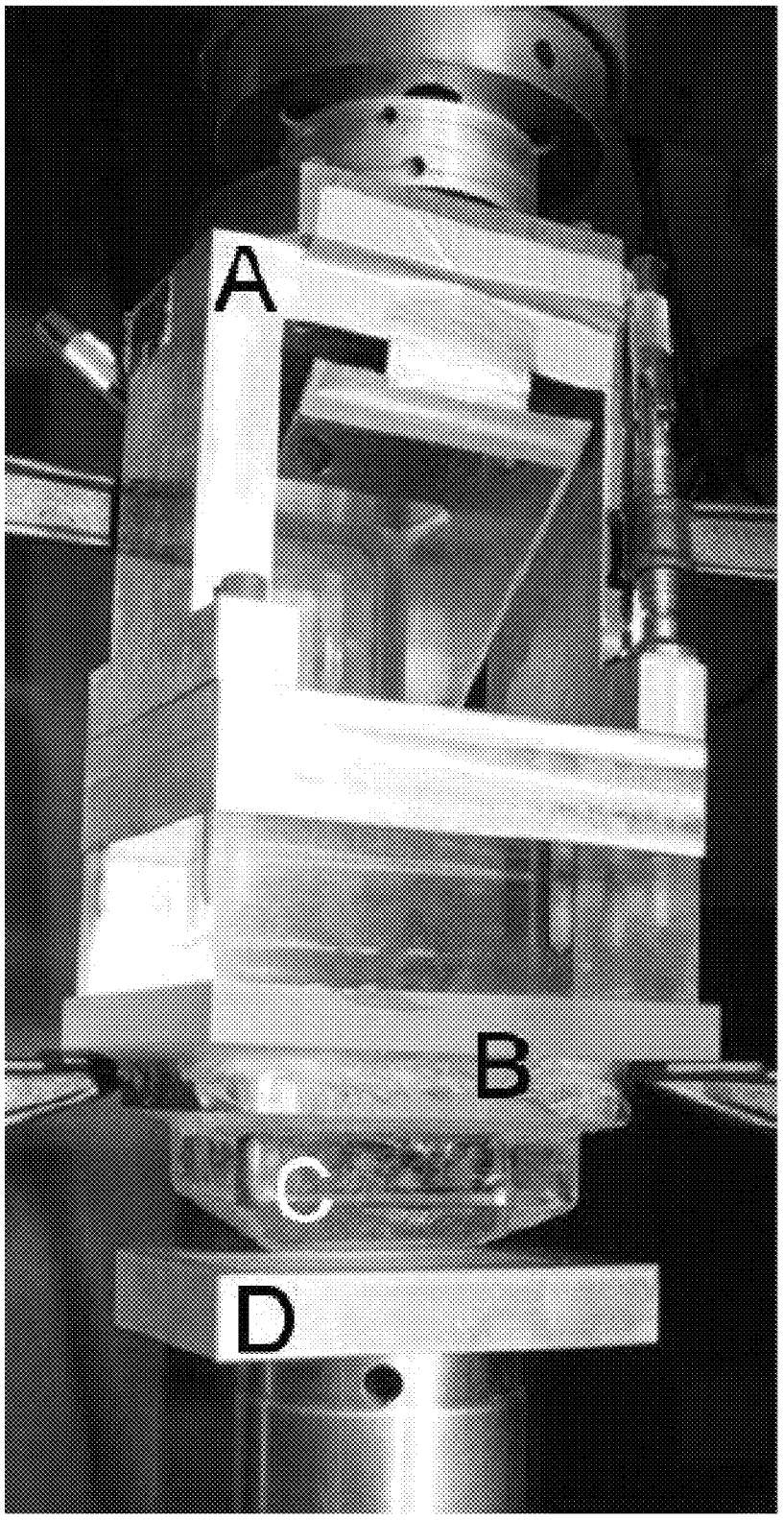
FIG. 14 is an image of the test setup used to verify the present invention.

The test setup is shown in FIG. 14. The ice samples were confined at their bases by freezing them into the ice holders. The bottoms of the holders were made of acrylic to permit viewing of the ice crushing behaviour at the contact zone through the reasonably transparent bulk of the ice samples. The test setup includes A a strong housing for the viewing mirror, which is inclined at an angle of about 45°, and allows a view through the acrylic and ice. This mirror was used for high speed imaging of the ice during the test. B is an acrylic and steel ice holder. C is the ice sample, and D is the aluminum crushing plate shown in FIG. 11. The setup was internally instrumented with a servo controller operating in a displacement control mode. The displacement was measured by an internal linear variable differential transformer (LVDT).

The drive mechanism used was a closed-loop hydraulically-driven load system (MTS™ Frame) and it ensured a constant rate of advance during the ice crushing experiments. Load was measured by means of a load cell positioned between the test frame crosshead and a top of the mirror housing. Load and displacement were recorded digitally at a sampling rate of approximately 6.1 kHz. A high speed imaging camera was used to capture images at a rate of 1500 images/s.

Figure 15:
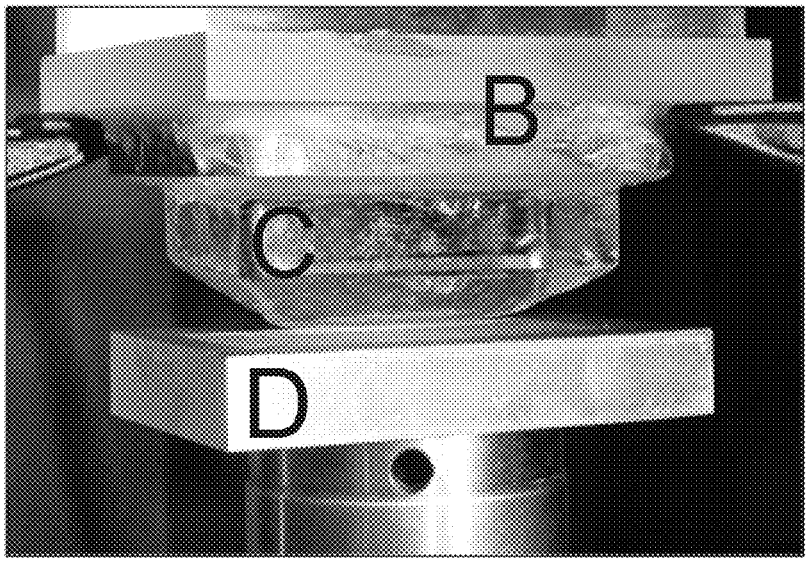
FIGS. 15, and 16 are enlarged images of the test setup of FIG. 14, focusing on the ice, its mounting and the blade.
Figure 16:
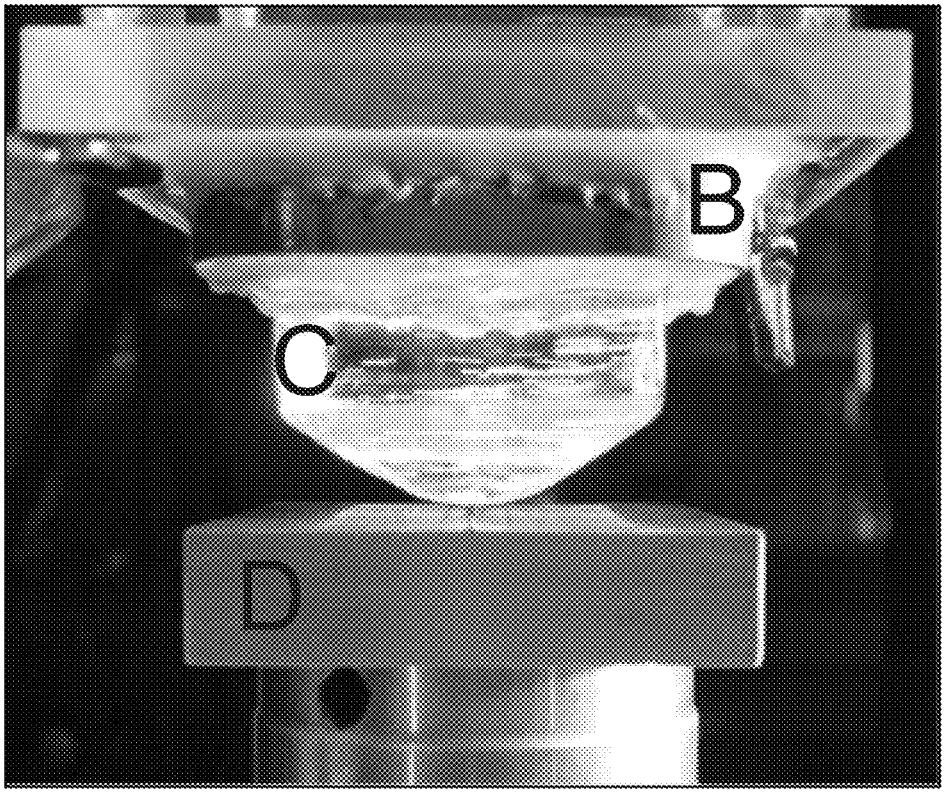

FIGS. 15 and 16 show ice samples mounted in holders just prior to the experiment. In FIG. 15, the blade was a bladeless crushing plate, and the view is mostly of the side. FIG. 16 is an end view of the ice sample mounted on the blade-bearing crushing plate. The blade is visible directly below the ice specimen. In FIG. 16 the columnar ice grains that make up the sample are oriented horizontally and their long axes are perpendicular to the direction of view, to facilitate viewing.

During the experiment, the crushing plate was pushed against the ice at a constant rate. Tests were conducted at −10° C. and the nominal crushing plate displacement rate was 10 mm/s. The ice was crushed to a depth of approximately 3.4 cm for all tests.

It has been observed that, for a blade to be effective, it must be positioned in the hard zone region of ice contact. High speed imaging observations of the ice contact zone, as viewed through the ice samples themselves, showed that for three of the tests where the plate with the blade was used, the hard zone region of the ice contact zone was not at the location of the blade, that is, the hard zone was for most of the test duration somewhere to either side of the blade and was therefore not influenced by the blade. This was caused by the high degree of unrealistic confinement of the ice attributable to the ice holder that would not be the case if, for example, the edge of an ice sheet was crushed against the plate. In that case, an average position of the hard zone would be expected to remain localized in the mid region of the sheet thickness over the time of the interaction, even if it does move somewhat during the interaction, as has been shown in real ice edge crushing experiments (e.g. Frederking, 2004; Määttänen et al., 2011; Sodhi at al., 2001; Takeuchi et al., 1997). Fortunately, for two of the experiments, the video records showed that the hard zone of the ice contact was in the blade region and consequently the load record was affected. The nature of the effect is best described by viewing the load record from a typical test (Test 1) without the blade and a load record from one of the tests with the blade where it was well-positioned relative to the hard zone of the ice contact (Test 4).

Figure 17:
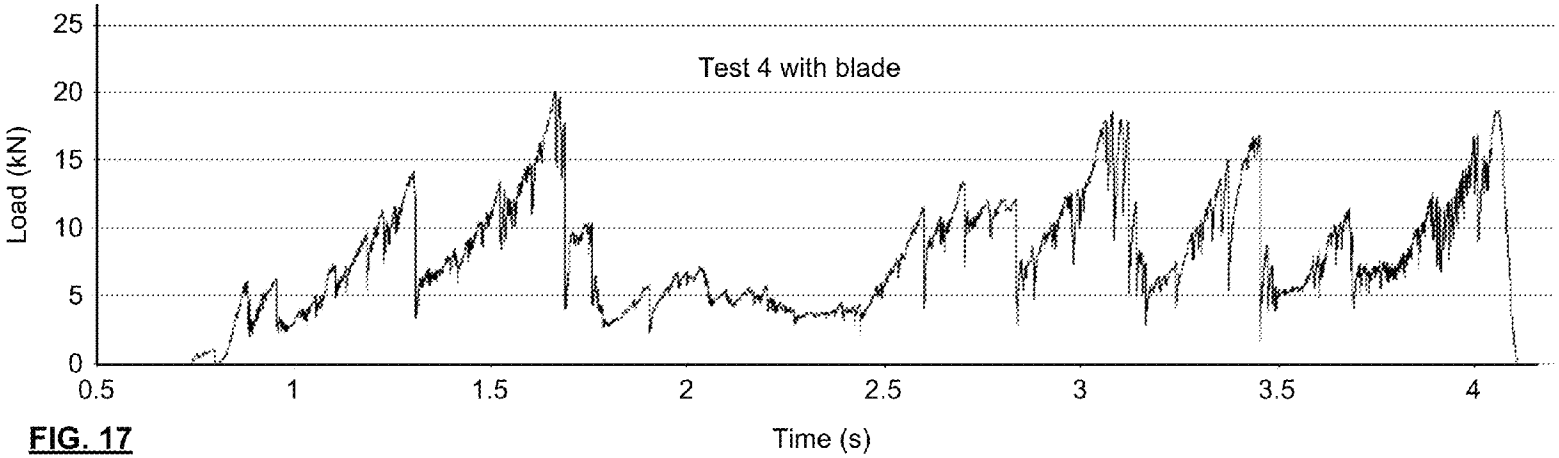
FIGS. 17 and 18 are time series plots of load cell data for tests with the blade, and without the blade, respectively.
Figure 18:
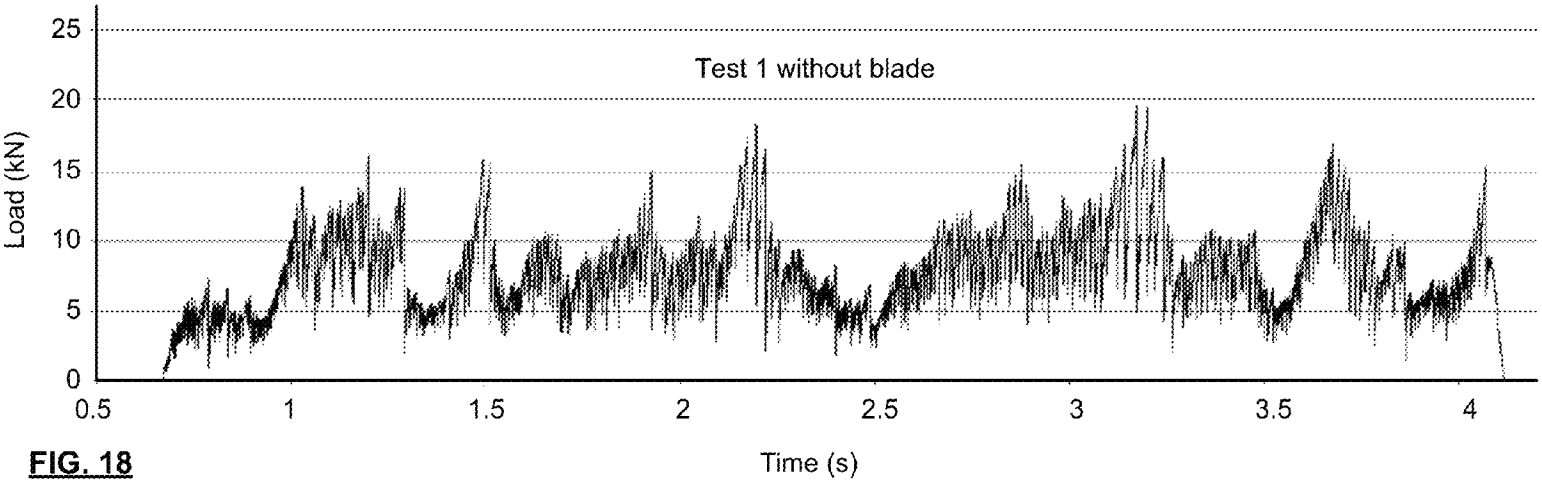
Figure 19:
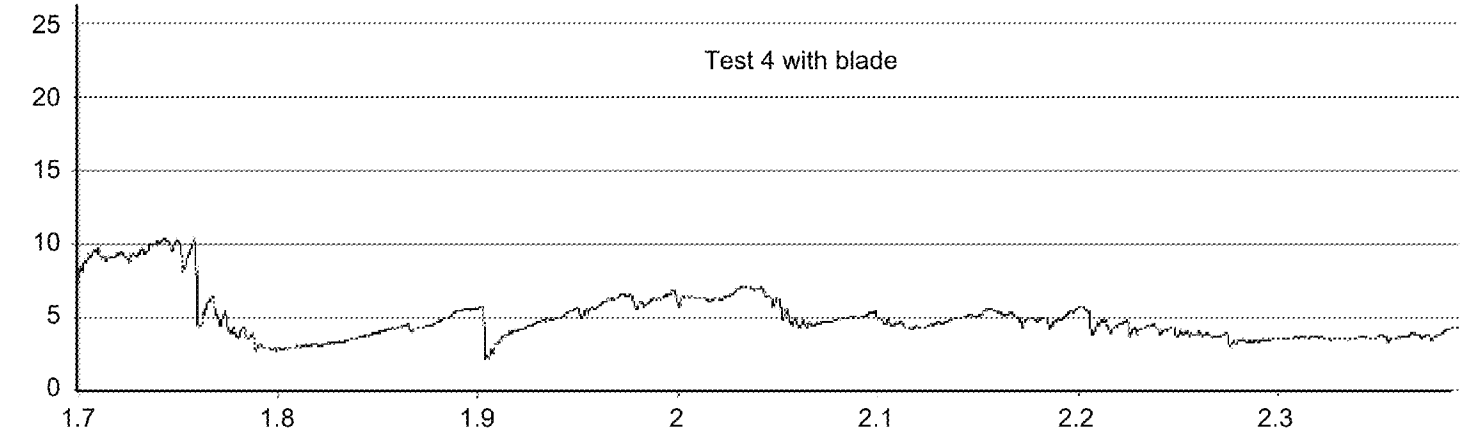
FIGS. 19 and 20 are enlargements of the time series plots of FIGS. 17 and 18 respectively.
Figure 20:
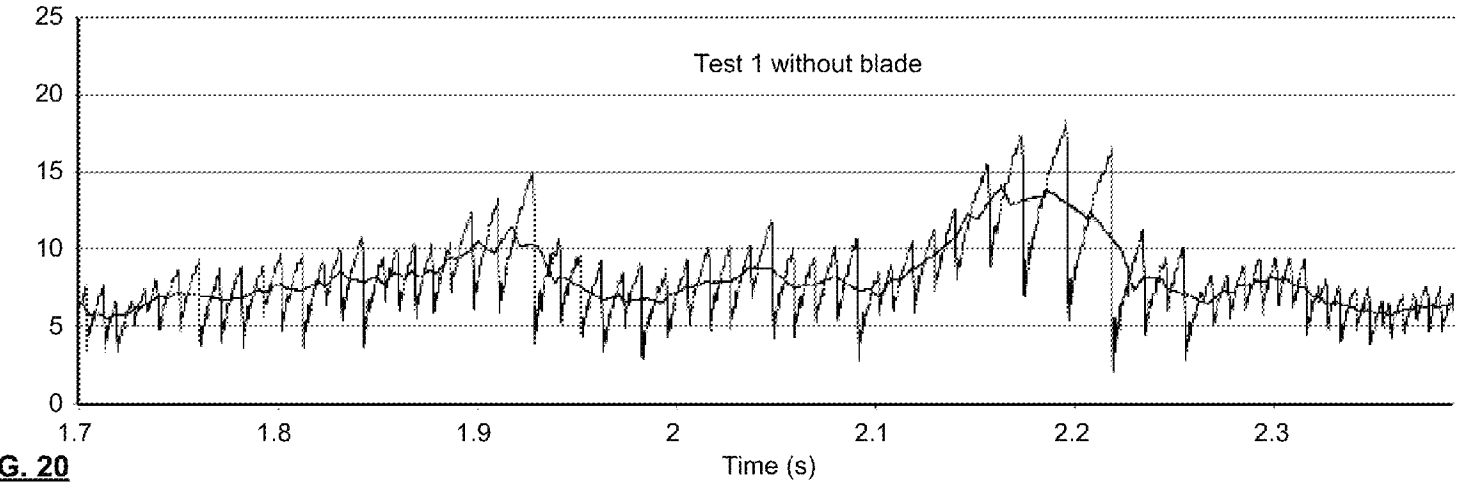

FIGS. 17 and 18 show the complete raw load time series data for the cases where the blade was present and when it was not The two records are distinctly different in that there are a large number of sawtooth oscillations in the record corresponding to the 'no blade' case, whereas the 'blade' case shows relatively few sawtooth oscillations. FIGS. 19 and 20 show expanded views of segments from the two load records so that the presence and absence of the sawtooth episodes is more clearly visible. In FIG. 20, a running average of the time series data is plotted over the time series data, which gives a load trace that would approximate the time series data if the blade had been present.

Figure 21A:
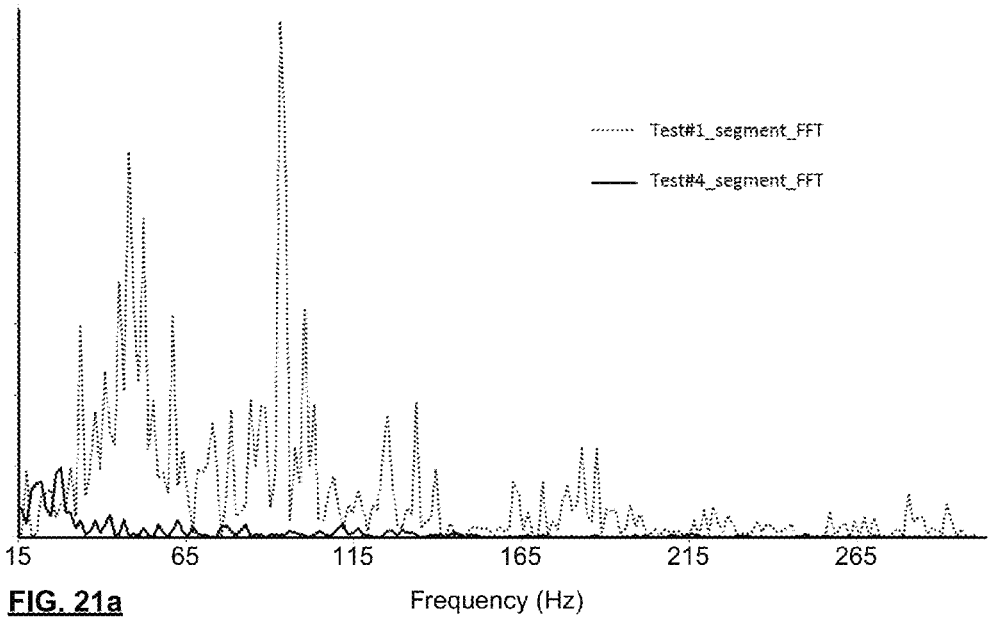
FIGS. 21 *a* and 21 *b* are frequency domain plots of the time series data of FIGS. 17 and 18, illustrating the successful decrease in low frequency, high amplitude load fluctuations with the blade in place.
Figure 21B:
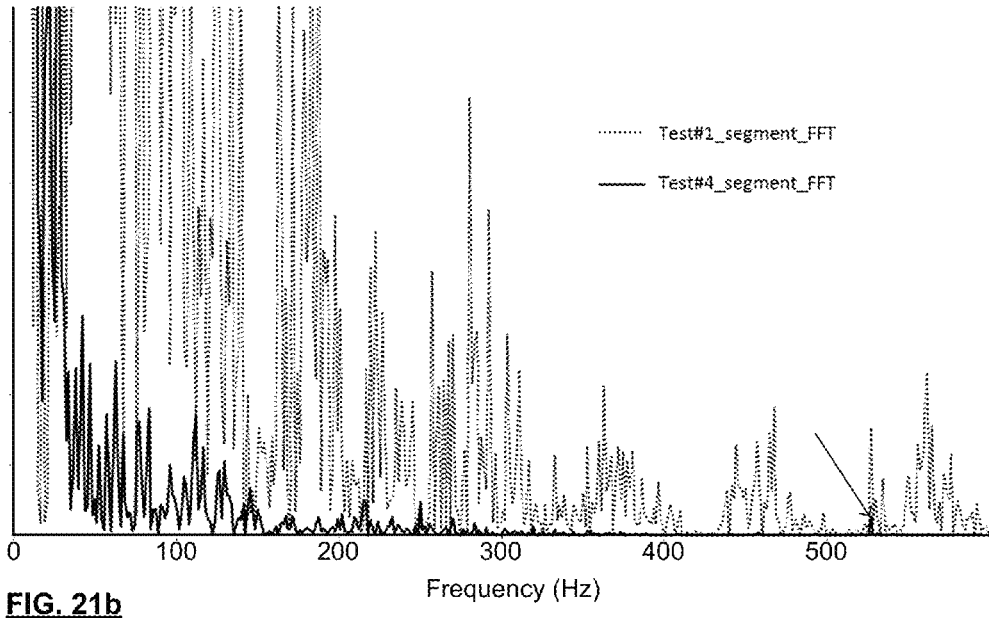

FIGS. 21*a* and 21*b* are frequency domain plots of the same data. FIG. 21*a* shows to what extent low frequency, high amplitude vibrations present in the bladeless test 1 (dashed plot) are reduced using a well-positioned, shallow blade test 4 (solid plot). The wide variety of high amplitude, low frequency peaks exhibited by test 1 are attributed to spading events. FIG. 21*b*, using the same legend and data, plots a frequency range of 0 to nearly 600 Hz focusing more on the test 4 data. Low amplitude peaks are evident throughout the spectrum, however a pronounced peak at around 525 Hz is noted which corresponds with a peak that is believed to represent a spalling rate that was noted in the load record. While there are certainly higher frequency excitation modes exhibited during the ice crushing, and there is a lot of noise in the frequency domain plot of test 1, these are not attributed to spalling.

The physical behaviour of the ice during the crushing is responsible for the load record characteristics in both cases. The key thing to note is that an ice spalling event is responsible for the sharp drop in load associated with any particular load sawtooth. In the case where no blade is present the spacing of the load sawteeth is such that there is significant buildup of elastic stress in the ice/apparatus system between spalling events, hence the load sawteeth have high amplitudes. In the case where the blade is present there are still spalling events occurring, and associated load sawteeth, however the frequency of the sawtooth pattern is much higher than in the previous case and there is consequently much less elastic stress build up in the ice/apparatus between the events. Hence the amplitudes of the sawteeth are very small and barely discernible compared to the 'no-blade' case. The effect of the blade is to initiate many more spalling events than would have occurred with a bladeless crushing plate. From previous experiments (Gagnon, 2008) it was observed that spading events initiate from the central region of the hard zones during ice crushing. In the present tests the blade accelerates the initiation of spalling events dramatically.

Statistics from the present tests indicated that the average loads over the durations of the tests were roughly the same regardless of the presence or absence of the blade. The effect of the blade is to dramatically increase the frequency of spalling events and in so doing reduce the size of the spalls and the associated amplitudes of the load sawteeth.

In summary, the blade effectively mitigates large-amplitude sawtooth loading by increasing the spalling rate and consequently reducing the sawtooth load amplitude. Note that the main characteristics of ice crushing behaviour apply to a wide range of scale size (Gagnon, 1999). Hence the type of blade effect observed in the present tests would be very beneficial in the case of a large offshore structure against which an ice sheet is moving and crushing, such as occurred with the Molikpaq structure in the Beaufort Sea in 1986. Very large oscillations of the structure occurred as the result of the sawtooth bad pattern that developed as the ice sheet advanced (Gagnon, 2012). We would expect that had there been a stationary blade, appropriately scaled, horizontally-oriented, spanning the width of the structure and positioned in the middle of the ice sheet thickness, that the large and dangerous spalling-induced oscillations of the structure would not have occurred.

Figure 22:
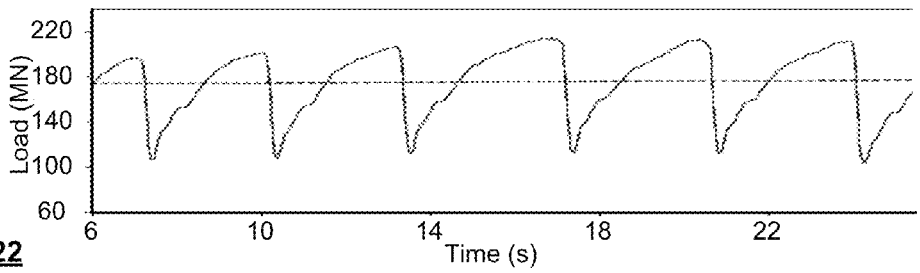
FIG. 22 is a load time series data plot of a brief part of the ice-structure interaction that occurred on the Molikpaq caisson facility, with a mean value overlaid thereon.

FIG. 22 shows actual sawtooth bad data from the May 12, 1986 Molikpaq event. The dashed trace on the chart is simply a linear fit to the load data that roughly approximates the anticipated load trace that would have resulted if a stationary blade protruding ~3.3 cm into the hard zone, had been installed on the north face of the Molikpaq structure.

REFERENCES

The contents of the entirety of each of which are incorporated by this reference Frederking, R., 2004. Ice Pressure Variations during Indentation. Proc. IAHR Symposium on Ice, St. Petersburg, Russia, pp. 307-314.

Gagnon, R. E., 1999, Consistent observations of ice crushing in laboratory tests and field experiments covering three orders of magnitude in scale. Proc. POAC-99, Helsinki, Finland, 2, pp. 858-869.

Gagnon, R. E., 2008. High-speed imaging of mechanisms responsible for sawtooth cyclic loading during ice crushing. Proceedings of IAHR 2008, Vancouver, Canada, volume 2, pp. 983-991.

Gagnon, R., 2012. An Explanation for the Molikpaq May 12, 1986 Event. Cold Regions Science and Technology 82 (2012) 75-93.

Määttänen, M., Marjavaara, P., Saarinen, S., 2011. Ice crushing pressure distribution against a compliant stiffened panel. Proc. 21st Int. Conf. On Port and Ocean Engineering under Arctic Conditions, Montreal, Canada, POAC 2011, paper #038.

Sodhi, D. S., Takeuchi, T., Nakazawa, N., Kawamura, S. A. M., 2001. Measurements of ice force and interfacial pressure during medium-scale indentation tests in Japan. Proc. 16th International Conference on Port and Ocean Engineering under Arctic Conditions, Ottawa, Ontario, Canada, pp. 617-626.

Takeuchi, T., Masaki, T., Akagawa, S., Kawamura, M., Nakazawa, N., Terashima, T., Honda, H., Saeki, H., Hirayama, K., 1997. Medium-scale field indentation tests (MSFIT)—ice failure characteristics in ice/structure interactions. Proc. of the 7th Int. Offshore and Polar Engineering Conference, Honolulu, USA, vol. II, pp. 376-382.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A method for protecting a structure from interaction with an ice sheet, the method comprising:

providing a horizontal spall initiator comprising at least one blade segment extending from a wall of the structure, or from one panel or from a plurality of panels thereon, a distance of 1 to 10 cm, the at least one blade segment being resilient to the ice interaction, and having a blade width less than ½ a thickness of an expected hard zone of the ice; and aligning the horizontal spall initiator to an elevation corresponding to the expected hard zone prior to the interaction with the ice sheet, the hard zone being a central horizontal region of the ice sheet.

2. The method of claim 1 wherein providing the horizontal spall initiator comprises providing a continuous horizontal blade on the wall, or on the one panel on the wall.

3. The method of claim 1 wherein a profile of the at least one blade segment has an aspect ratio of 2:1 to 1:1.

4. The method of claim 1 wherein providing the horizontal spall initiator comprises providing a plurality of blade segments that are separated from each other to discontinuously define the horizontal spall initiator; the blade segments being provided on the one panel, or one or more of the plurality of panels.

5. The method of claim 1 wherein providing the horizontal spall initiator comprises providing a plurality of the blade segments in two or more rows, with separations between adjacent blade segments on the same row, wherein blade segments are systematically aligned with separations in adjacent rows, to interleave blade segments of different elevations.

6. The method of claim 5 wherein the plurality of horizontal spall initiators are affixed to a shoulder of a ship plated for ice contact.

7. The method of claim 1 wherein aligning the horizontal spall initiator involves at least one of:

controlling an elevation of the one panel or the plurality of panels with respect to the wall to correspond with the elevation of the hard zone;

fixing a single horizontal blade at a given height if there are a narrow range of elevations at which the ice sheet is expected, and ice sheets are expected in a narrow range of thicknesses; and providing the blade segments in a staggered pattern so that the horizontal spall initiator is formed by a first set of blade segments that overlie a second horizontal spall initiator formed by a second set of blade segments, with a separation between the first and second sets of blade segments being chosen to be greater than the vertical width of the hard zone anticipated for the thickest ice sheet expected.

8. The method of claim 7 wherein controlling the elevation comprises mounting the one panel or the plurality of panels for sliding movement, the sliding movement being controlled by a mechanical system, hydrodynamic system, buoyant system or a combination of the above.

9. The method of claim 1 wherein the wall is a wall of a pillar, the one panel or plurality of panels is a part of a sleeve that surrounds the pillar, and the sleeve is joined to the pillar in a revolute, or nonrevolute fashion.

10. A kit comprising instructions for using material or panel in accordance with the method of claim 1 and at least one of: material or instructions for producing a horizontal spall initiator on the wall, and one panel or a plurality of panels providing the horizontal spall initiator as defined in claim 1.

11. The kit according to claim 10 wherein the one panel or the plurality of panels is provided, and the kit further comprises a mounting system for mounting the one panel or plurality of panels to the wall.

12. The kit according to claim 11 wherein the mounting system: is adapted to allow for varying an elevation of the horizontal spall initiator provides a driver for driving the horizontal spall initiator into the ice during an ice-structure interaction; or comprises one or more of a mechanical system, a hydrodynamic system, and buoyancy system for controlling the variation of the elevation.

13. The kit according to claim 11 wherein the one panel or the plurality of panels is a part of a sleeve for surrounding a pillar.

14. A method for protecting a structure from interaction with an ice sheet, the method comprising:

providing a horizontal spall initiator comprising at least one blade segment extending from a wall of the structure, or from one panel or from a plurality of panels thereon, a distance of 1 to 10 cm, the at least one blade segment being resilient to the ice interaction, and having a blade width less than ½ a thickness of an expected hard zone of the ice sheet;

situating the horizontal spall initiator at an elevation of the expected hard zone, the hard zone being a central horizontal region of the ice sheet; and preventing vertical motion of the horizontal spall initiator throughout the interaction.

15. The method of claim 14 wherein providing the horizontal spall initiator comprises providing a continuous horizontal blade on the wall, or on the one panel on the wall.

16. The method of claim 14 wherein a profile of the at least one blade segment has an aspect ratio of 2:1 to 1:1.

17. The method of claim 14 wherein providing the horizontal spall initiator comprises providing a plurality of blade segments that are separated from each other to discontinuously define the horizontal spall initiator the blade segments being provided on the one panel or plurality of panels.

18. The method of claim 14 wherein situating the horizontal spall initiator involves at least one of:

controlling an elevation of the one panel or plurality of panels with respect to the wall to correspond with the hard zone;

fixing a single horizontal blade at a given height if there are a narrow range of elevations at which the ice sheet is expected, and ice sheets are expected in a narrow range of thicknesses; and providing the blade segments in a staggered pattern so that the horizontal spall initiator is formed by a first set of blade segments that overlie a second horizontal spall initiator formed by a second set of blade segments, with a separation between the first and second sets of blade segments being chosen to be greater than the vertical width of the hard zone anticipated for the thickest ice sheet expected.

19. The method of claim 18, wherein controlling the elevation comprises mounting the one panel or the plurality of panels for sliding movement, the sliding movement being controlled by a mechanical system, hydrodynamic system, buoyant system or a combination of the above.

20. The method of claim 14 wherein the wall is a wall of a pillar, the one panel or plurality of panels is a part of a sleeve that surrounds the pillar, and the sleeve is joined to the pillar in a revolute, or nonrevolute fashion.

* * * * *